US005080354A

United States Patent [19]

McDougall

[11] Patent Number: 5,080,354

[45] Date of Patent: Jan. 14, 1992

[54] SLIDING BOLT DOOR LOCKING APPARATUS MOUNTABLE ON ANY EDGE OF A HINGED DOOR AND METHODS OF INSTALLATION

[75] Inventor: Michael R. McDougall, P.O. Box 183/98362 Port Angeles, Wash.

[73] Assignee: Michael R. McDougall, Port Angeles, Wash.

[21] Appl. No.: 654,333

[22] Filed: Feb. 11, 1991

[51] Int. Cl.[5] ..... E05C 1/04

[52] U.S. Cl. ..... 292/145; 292/DIG. 17; 292/42

[58] Field of Search ..... 292/DIG. 17, 137, 145, 292/147, 32, 42, 183, 189, 346, 288, 302, 150

[56] References Cited

U.S. PATENT DOCUMENTS

| | | | |
|---|---|---|---|
| 1,245,049 | 10/1917 | Silverstein | 292/145 |
| 1,377,458 | 5/1921 | Block | 292/346 |
| 1,510,562 | 10/1924 | Segal | 292/150 |
| 1,707,694 | 4/1929 | Torrence | 292/DIG. 17 X |
| 2,854,839 | 10/1958 | Eads | 70/139 |
| 3,697,106 | 10/1972 | Meyer | 292/340 X |
| 4,014,571 | 3/1977 | Ellis | 292/DIG. 17 X |

*Primary Examiner*—Richard E. Moore

[57] ABSTRACT

Sliding bolt door locking apparatus that may be installed on the inside or outside surface of any door, and which may be installed on any side of the door. The sliding bolt locking apparatus may be easily bolted to an existing door and does not require removal of significant material for installation. The apparatus may be installed on the interior surface of a hinged door, and on any side of the door, including that side of the door having the hinge. Four separate sliding door locking apparatus assembles may be installed on the four interior sides of a hinged door for increased security against unwanted entry.

3 Claims, 4 Drawing Sheets

SLIDING BOLT DOOR LOCKING APPARATUS MOUNTABLE ON ANY EDGE OF A HINGED DOOR AND METHODS OF INSTALLATION

This invention relates to new sliding bolt door locking apparatus which may be simply installed on any surface of a door that is adjacent to any side (or "edge") of the door. The invention is also called a sliding bolt locking plate system. It may be retrofired on an already existing door by simply bolting it in place. This installation procedure does not involve removing significant material portions of the door during any such retrofiting operation which is typical of much of the prior art.

The sliding bolt door locking apparatus may be installed on the outside surface of a door. It may be installed on the interior surface of a door. It may be installed on the interior surface of a hinged door on a side of the door opposite the side having the hinge. It may be installed on the interior surface of a hinged door on the same side of the door having the hinge.

The fact that the sliding bolt door locking apparatus may be installed conveniently on any surface of the door and adjacent any side of the door is due to new features provided by this invention. Numerous U.S. patents have provided sliding bolt locking means, including U.S. Pat. No. No. 2,854,839 that Eads on Oct. 7, 1958. That patent describes an invention that requires removing material within the door for installation. In contrast, the invention herein simply bolts in place during any installation procedure and does not require any such removal of material. Further, the invention herein is designed to operate effectively on any surface of the door adjacent any edge of the door whereas U.S. Pat. No. 2,854,839 provides no such intended or designed operation.

Accordingly an object of the invention is to provide new sliding bolt locking apparatus mountable on any surface of a door adjacent any edge of a door.

Another object of the invention is to provide new sliding bolt locking apparatus mountable on any surface a door that simply bolts in place and which does not require significant removal of material within the door for installation.

Another object of the invention is to provide new sliding bolt locking apparatus mountable on the inside surface of a hinged door adjacent to the edge of the door having the hinge.

It is yet another object of the invention to provide a method of operation of the sliding bolt locking apparatus wherein four separate sliding bolt locking plate systems are installed on four each sides of an interior door thereby providing increased security against unwanted entry.

Figure 1:
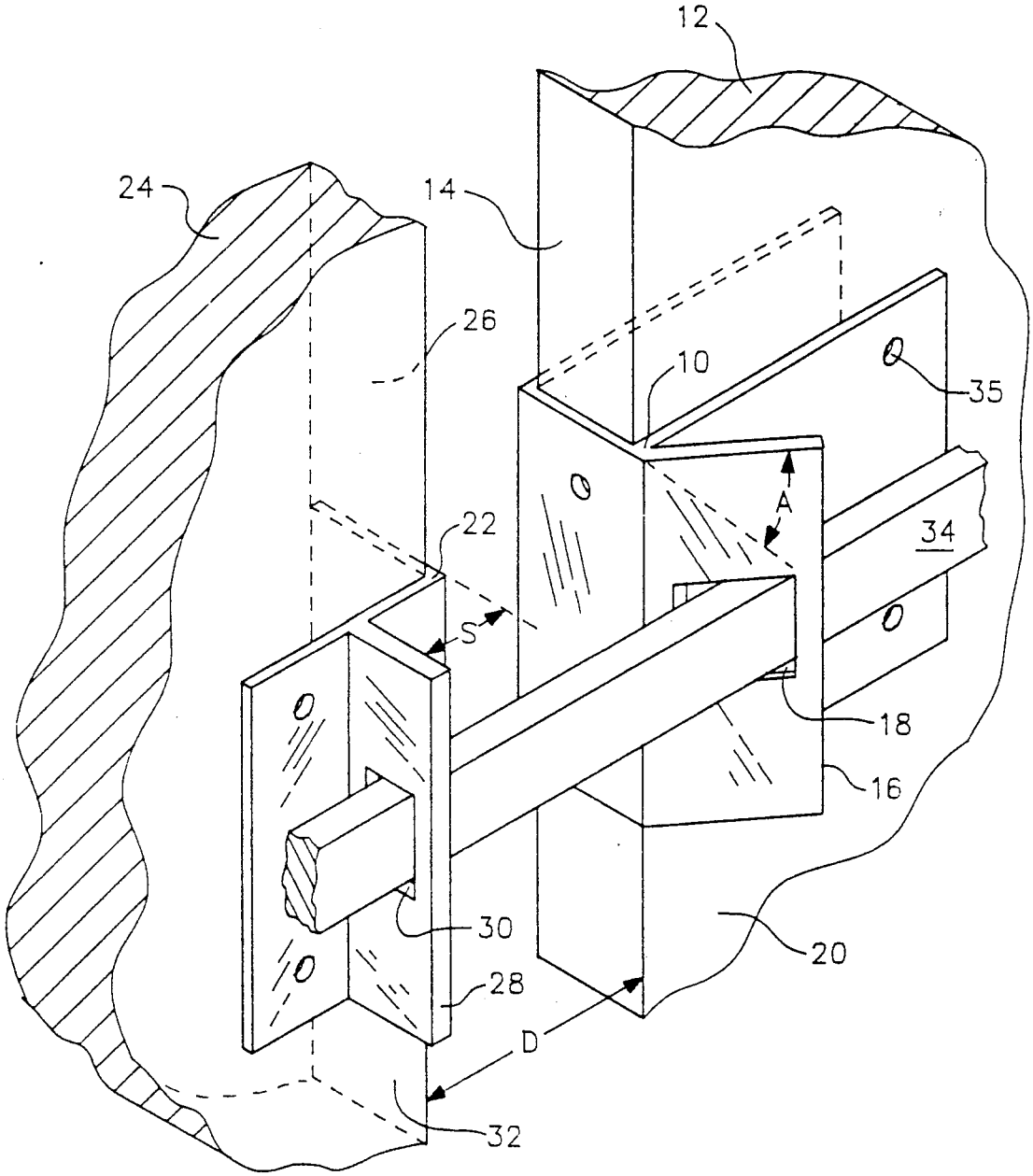
FIG. 1 is a perspective view of a preferred embodiment of the sliding bolt locking apparatus installed on an edge of a hinged door opposite the side of the door having the hinge.

A preferred embodiment of the invention is shown in perspective in FIG. 1. First mechanical assembly 10 is mounted on hinged door 12. Only a portion of hinged door 12 is shown in the form of a "cut-out" in the perspective in FIG. 1. The hinged door 12 is capable of hinged movement as is typical in the construction industry. Hinged door edge 14 may represent any edge of the hinged door. In the particular chosen example, hinged door edge 14 represents the edge of the door opposite the portion of the door having the hinge. First mechanical assembly 10 has angle piece 16 having angle piece hole 18. Angle piece 16 is oriented at the angle "A" with respect to the plane defined by the hinged door edge 14. That angle is labeled with the legend "A" in FIG. 1. Surface 20 of the door may represent any surface of the door, either the "inside" or "outside" surfaces. In the particular chosen example, surface 20 represents the inside surface of the hinged door 12.

Second mechanical assembly 22 is mounted on the door frame 24. The door frame 24 is fixed and incapable of movement as is typical in the construction industry. Only a portion of door frame 24 is shown in the form of another "cut-out" in the perspective in FIG. 1. The door frame 24 as defined herein may represent any portion of the enclosure of the building structure surrounding the hinged door. In the particular chosen example, door frame 24 is that portion of the door frame which is opposite the portion of the door frame having the hinge. FIG. 1 shows the perspective appropriate when the hinged door is in the "closed position" within the door frame. In the closed position, door frame edge 26 is in an orientation directly opposite hinged door edge 14 which are then separated by a distance D. In the closed position, therefore the hinged door edge 14 is parallel to door frame edge 26. Second mechanical assembly 22 has extended flange portion 28 which has extended flange hole 30. Extended flange portion 28 is parallel to the plane defined by door frame edge 26, but is "set-back" from the door frame edge by the distance S. That "set-back distance" is labeled with the legend "S" in FIG. 1. Surface 32 of the door frame may represent any surface of the door frame, either "inside" or "outside" surfaces. In the particular chosen example, surface 32 represents the inside surface of the door frame.

In the perspective in FIG. 1, the door is in the "closed position". In the closed position, angle piece hole 18 is in line with extended flange hole 30. When in this closed position, sliding bolt 34 passes through both angle piece hole 18 and through extended flange hole 30. Sliding bolt 34 is fabricated from a rigid material such that when passing through both holes, the hinged door is effectively "locked in place".

In the particular chosen example, the door may be locked in place from the "inside". Unwanted attempted entry from the outside surface of the door results in movement of mechanical assembly 10 until the sliding bolt 34 "jams" or locks in place within angle piece hole 18 and extended flange hole 30 respectively. A typical screw clearance hole 35 is shown that accepts a screw used to partially hold assembly 10 in place. Other similar holes are shown but not labeled in FIG. 1.

Figure 2:
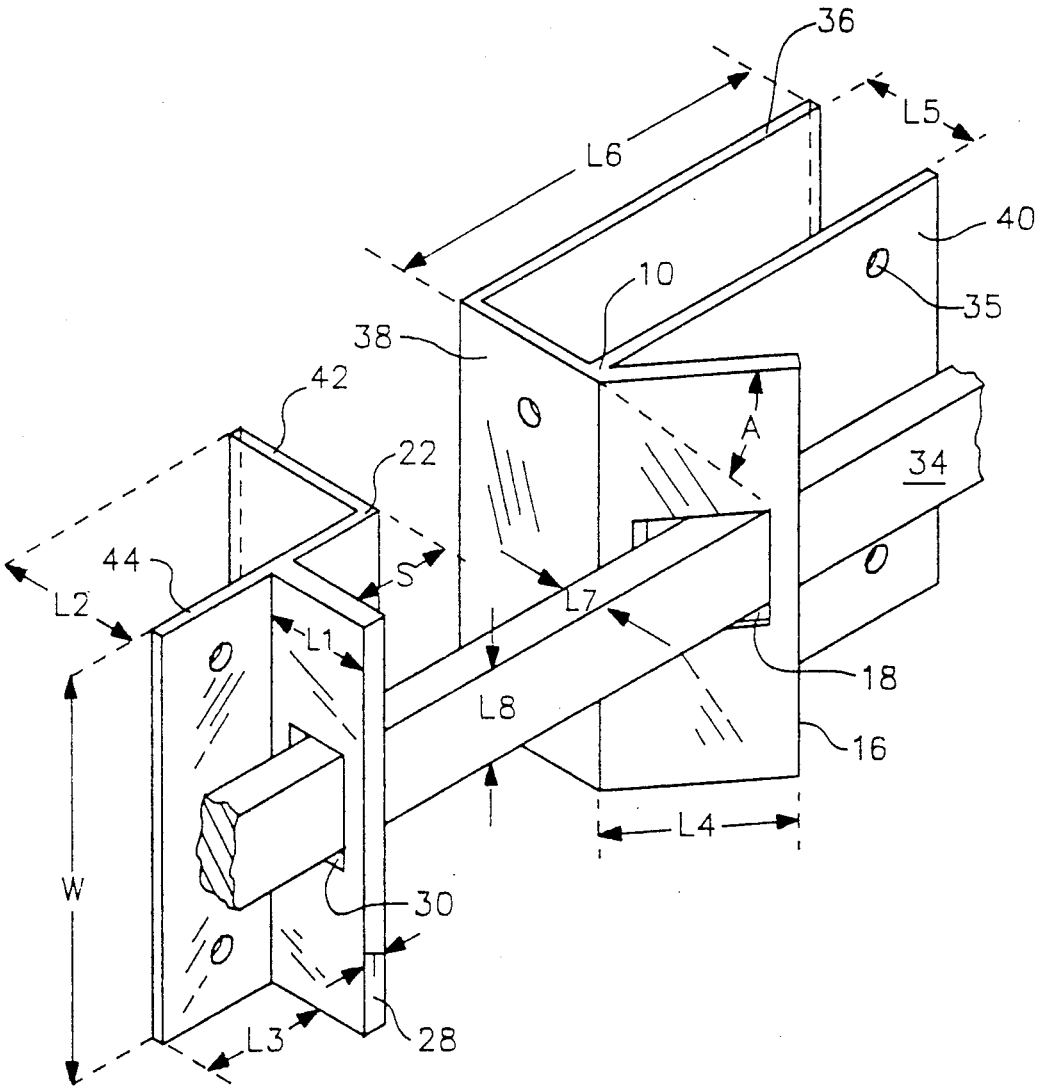
FIG. 2 is a perspective view of mechanical parts comprising a preferred embodiment of the invention.

FIG. 2 shows details of the first mechanical assembly 10, details of the second mechanical assembly 22, and details of the sliding bolt. FIG. 2 is similar to that shown in FIG. 1 except in FIG. 2, the "cut-out" portions of the hinged door 12 the "cut-out" portions of door frame 24 have been removed from the perspective, and additional detail of the parts are shown in FIG. 2.

In FIG. 2, the first mechanical assembly 10 is a one-piece unit comprised respectively of four flat steel plates: the first plate; the second plate; the third plate; and the fourth plate—which is the angle piece 16. First plate 36 is connected to second plate 38 by a right angle, and second plate 38 is attached to third plate 40 by a right angle, the first, second, and third plates comprising a "right angle U shaped channel". The "right angle U shaped channel" is fabricated to surround the portions of the edge, and of the inside and outside surfaces of door 12 as already shown in FIG. 1. In FIG. 2, attached to the third plate 40 is angle piece 16 (also called the fourth plate) which has angle piece hole 18, wherein the angle piece is fabricated at an angle "A" to the plane defined by plate 38. When installed, plate 38 is parallel to the edge of the door 14. The angle "A" is labeled with legend "A" in FIG. 2. The angle piece hole 18 is fabricated to accept the sliding bolt 34. Therefore, first mechanical assembly 10 is a right angle U shaped channel attached to an edge portion of a hinged door having an angle piece which in turn has angle piece hole, the angle piece and hole being located adjacent to the inside surface of the hinged door.

In FIG. 2, the second mechanical assembly 22 is a one-piece unit comprised respectively of three flat steel plates: the fifth plate; the sixth plate; and the seventh plate—which is the extended flange portion 28. Fifth plate 42 is connected to sixth plate 44 at a right angle. The seventh plate, also called the extended flange portion 28, is joined to said sixth plate at a right angle such that it is in a plane parallel to the plane defined by the door frame edge 26, but is otherwise "set-back" from that plane by the distance S defined in FIG. 2. The second mechanical assembly 22 is therefore comprised of a right angle assembly with extended flange portion set back the distance S from the plane of the door frame, the extended flange portion 28 having the extended flange hole 30 fabricated to accept sliding bolt 34. The dimensions L1, L2, L3, L4, L5, L6, L7, L8 and W are defined with legends in FIG. 2. Not shown are the horizontal width L9 and vertical height L10 of hole 18. Not shown are the horizontal width L11 and vertical height L12 of hole 30. The thickness T of all the metal plates are shown in to be approximately the same in FIG. 2.

Figure 3:
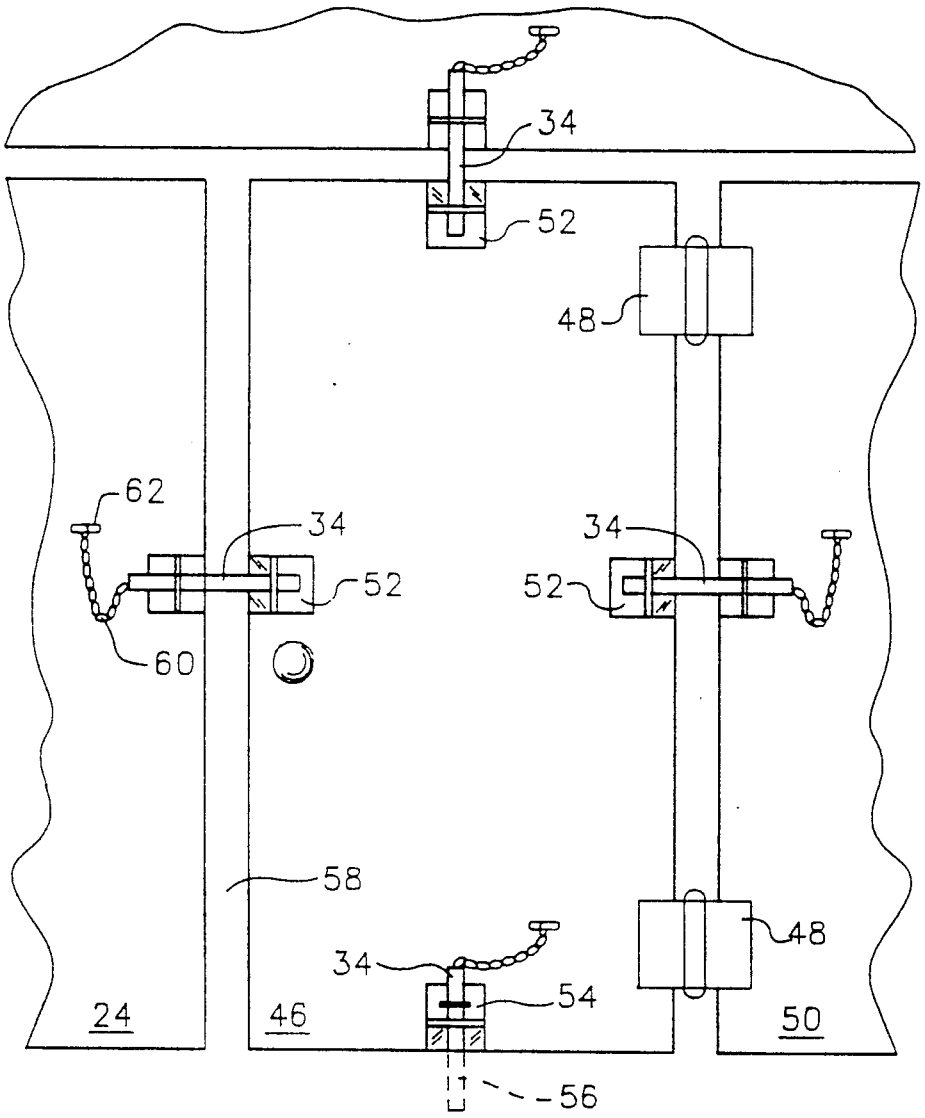
FIG. 3 is an inside flat view of the interior of a hinged door with four each sliding bolt locking plate systems installed on four different edges of the door.

FIG. 3 is an inside flat view of the interior of a hinged door with four each sliding bolt locking plate systems installed on four different sides of the door. Hinged door 46 has hinges 48 installed on the door and on the door frame 50 located on the right-hand side of the door of this interior view. Identical sliding bolt locking plate systems 52 are attached respectively to the top, right-hand, and left-hand sides of the door as shown. The respective sliding bolts 34 are shown in FIG. 3. A portion of the sliding plate locking plate system 54 is shown on the bottom of the door which is comprised of mechanical assembly 10 and sliding bolt 34 in FIGS. 1 and 2. The sliding bolt 34 penetrates a hole in the floor 56. Exaggerated clearance 58 is shown between the left-hand portion of the door and the left door frame 24. Exaggerated clearances between the door and the other portions of the door frame are shown in FIG. 3 but are not labeled. For matter of convenience only, chain 60 attached to both the sliding bolt 34 and wall mounted bracket 62 are used to suspend the sliding bolt when the door is open.

Figure 4:
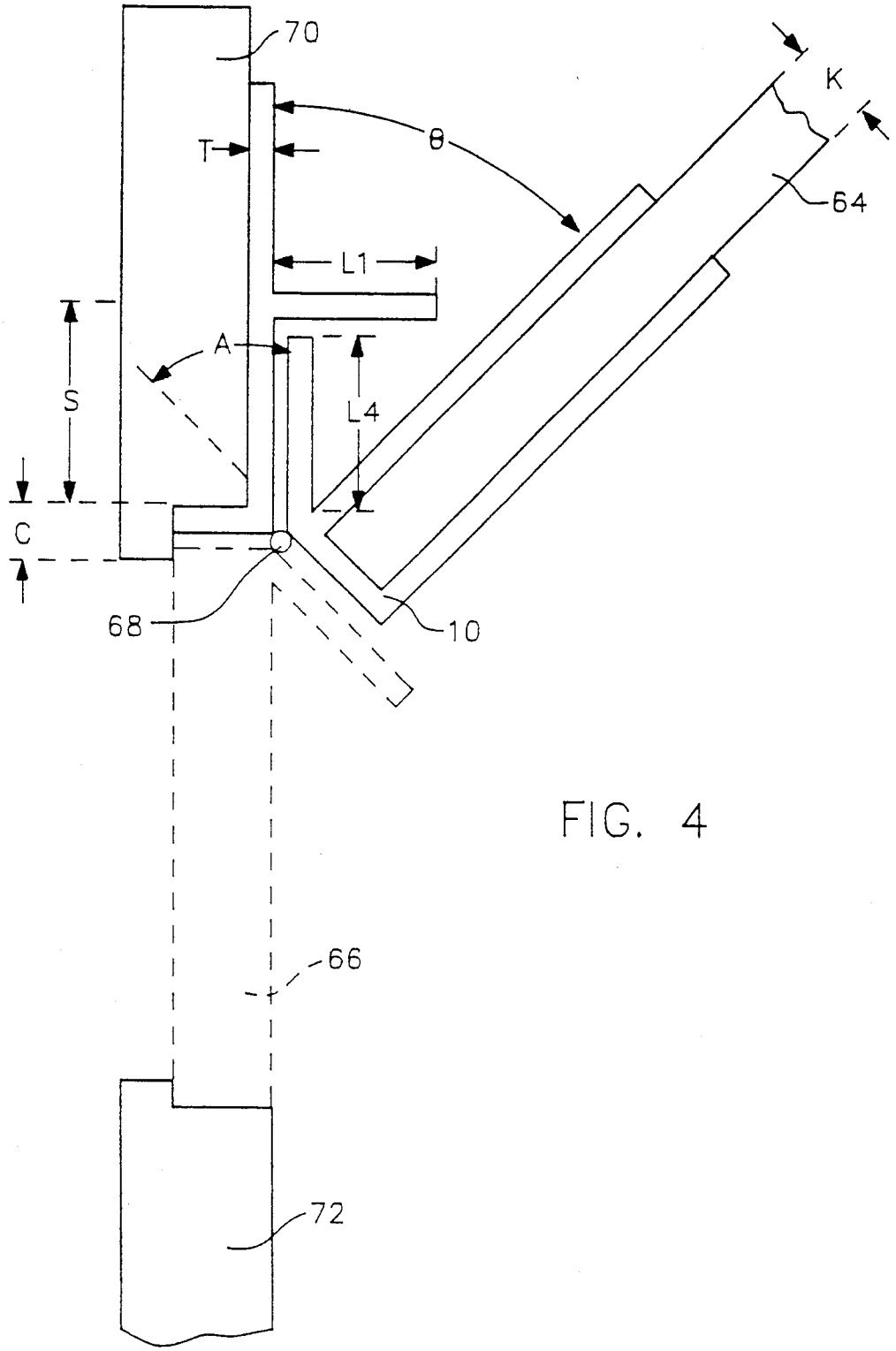
FIG. 4 is a top view of the sliding bolt locking apparatus installed on the interior surface of a door that is located on the side of the door having the hinge with the door in the open position.

FIG. 4 is a top view of the sliding bolt locking apparatus installed on the interior surface of a door that is located on the side of the door having the hinge with the door in the open position. Open door 64 is shown in FIG. 4. The position of the door when closed is shown with dashed lines labeled with the number 66. The door pivots about hinge 68 mounted in door frame 70. The portion of the door frame 72 opposite that portion having the hinge 70 is so labeled in FIG. 4. The insert dimension C and door thickness K are defined with legends in FIG. 4. From FIG. 4 it is evident how the setback distance S and angle A cooperate to allow the door to open to the full angle Θ provided that L4 is smaller than the setback distance S.

While several preferred embodiments of the invention have been described as installed on hinged doors, it is evident that the invention may be used on many different types of doors not having hinges. While the above description contains many specificities, these should not be construed as limitations on the scope of the invention, but rather as exemplification of preferred embodiments thereto. As has been described, there are many possible variations. Accordingly, the scope of the invention should be determined not only by the embodiments illustrated, but by the appended claims and their legal equivalents.

What is claimed is:

1. A sliding bolt locking plate system for locking a hinged door suitable for installation at any chosen location on the inside of the hinged door, said hinged door being installed in a door frame, comprising a first assembly suitable for attachment to the chosen side of the door, a second assembly suitable for attachment to the corresponding portion of the door frame, and a sliding bolt means, wherein said first assembly is fabricated to be one single part having first, second, third, and fourth plates respectively, wherein the first plate is connected to said second plate by a right angle, and wherein said second plate is attached to said third plate by a right angle, and wherein attached to said third plate is the fourth plate having a first hole, wherein said fourth plate is fabricated at an angle to said third plate, and wherein said first hole in said fourth plate is fabricated to accept the sliding bolt means, whereby the first assembly is installed at the chosen location on the hinged door such that the first plate is installed in contact with the front of the door, and whereby said third plate is installed in contact with the interior of the door, and wherein said second assembly is fabricated to be a one piece assembly having fifth, sixth, and seventh plates respectively, wherein said fifth and sixth plates are joined together at a right angle, wherein a second hole is fabricated in said seventh plate, wherein said seventh plate is joined to said sixth plate at a right angle such that said fifth and seventh plates are fabricated to be in geometric planes parallel to one another, and wherein said seventh plate is setback from the door frame edge by the setback distance, and wherein said second hole in said seventh plate is fabricated to also accept the sliding bolt means, whereby said second assembly is installed on the door frame opposite the chosen location of the first assembly, whereby said sixth plate of said second assembly is installed on the interior portion of the door frame, and whereby the fifth plate of said second assembly is installed on the face of the door frame, whereby said first and second assemblies are oriented such that said sliding bolt means may be used slide through both first and second holes respectively, and whereby said angle between said third and fourth plates is chosen to allow the door to open to a minimum door angel of at least 90 degrees for any chosen location on any side of the hinged door, thereby providing a positive locking plate system which may be locked from the inside of the door.

2. Sliding bolt locking apparatus for locking a hinged door that is mounted within a door frame comprising a sliding bolt, first mechanical means mounted on the interior surface of the door and adjacent a first edge of the door, second mechanical means mounted on the interior of the door frame adjacent said first means in the event that the door is in the closed position, said first and second means having respective first and second plates having holes to accept said sliding bolt, said first and second means being installed on the interior of the door and door frame such that said holes are aligned to accept the sliding bolt when locking the door, wherein said first and second plates having holes are arranged at an angle to one another and have a setback distance from one another to enable installation of said apparatus on any edge of a hinged door, including the edge of the door having the hinge.

3. The apparatus in claim 2 installed on four different sides of the interior surface of a hinged door thereby providing a method of operation of the sliding bolt locking apparatus that provides increased security against unwanted entry from the exterior side of the door.

* * * * *